US007436120B2

(12) United States Patent
Buschbeck et al.

(10) Patent No.: US 7,436,120 B2
(45) Date of Patent: Oct. 14, 2008

(54) COMPENSATION OF MAGNETIC FIELDS

(75) Inventors: Herbert Buschbeck, Vienna (AT); Gerhard Stengl, Wernberg (AT)

(73) Assignee: IMS Nanofabrication GmbH, Vienna (AT)

( * ) Notice: Subject to any disclaimer, the term of this patent is extended or adjusted under 35 U.S.C. 154(b) by 688 days.

(21) Appl. No.: 11/070,439

(22) Filed: Mar. 2, 2005

(65) Prior Publication Data

US 2005/0195551 A1 Sep. 8, 2005

(30) Foreign Application Priority Data

Mar. 3, 2004 (GB) ..... 0404805.4

(51) Int. Cl.
*H01J 29/06* (2006.01)

(52) U.S. Cl. ..... 315/8; 33/356; 324/207.12; 324/207.13; 361/146

(58) Field of Classification Search ..... 315/8; 33/356; 324/200, 202, 207.11, 207.12, 207.13, 324/207.14, 244, 244.1, 260; 361/139, 143, 361/146, 152

See application file for complete search history.

(56) References Cited

U.S. PATENT DOCUMENTS 3,701,007 A * 10/1972 Schad ..... 324/247
3,991,361 A * 11/1976 Mattern et al. ..... 324/244
4,801,883 A * 1/1989 Muller et al. ..... 324/252
4,849,695 A * 7/1989 Muller et al. ..... 324/252
5,066,891 A * 11/1991 Harrold et al. ..... 315/8
5,073,744 A 12/1991 Buhler ..... 315/8
5,170,566 A * 12/1992 Fowler et al. ..... 33/356
5,256,960 A * 10/1993 Novini ..... 324/72
5,469,058 A * 11/1995 Dunnam ..... 324/258
5,512,821 A * 4/1996 Ando et al. ..... 324/225
5,952,734 A * 9/1999 Gelbien ..... 307/91
6,208,135 B1 * 3/2001 Shattil ..... 324/225
6,211,671 B1 * 4/2001 Shattil ..... 324/225
6,348,791 B2 * 2/2002 Shattil ..... 324/225
6,984,989 B2 * 1/2006 Kudo et al. ..... 324/529

FOREIGN PATENT DOCUMENTS

GB 2 154 031 A 8/1985

* cited by examiner

*Primary Examiner*—Thuy Vinh Tran
(74) *Attorney, Agent, or Firm*—RatnerPrestia

(57) ABSTRACT

For compensation of a magnetic field in an operating region a number of magnetic field sensors (S1, S2) and an arrangement of compensation coils (Hh) surrounding said operating region is used. The magnetic field is measured by at least two sensors (S1, S2) located at different positions outside the operating region, preferably at opposing positions with respect to a symmetry axis of the operating region, generating respective sensor signals (s1, s2), the sensor signals of said sensors are superposed to a feedback signal (ms, fs), which is converted by a controlling means to a driving signal (d1), and the driving signal is used to steer at least one compensation coil (Hh). To further enhance the compensation, the driving signal is also used to derive an additional input signal (cs) for the superposing step to generate the feedback signal (fs).

22 Claims, 3 Drawing Sheets

COMPENSATION OF MAGNETIC FIELDS

CROSS-REFERENCE TO RELATED APPLICATION

This application claims the benefit of United Kingdom Patent application Ser. No. 0404805.4, filed 3 Mar. 2004.

FIELD OF THE INVENTION AND DESCRIPTION OF PRIOR ART

The invention relates to an improvement in the compensation of a magnetic field in a predefined operating region with feedback control, using magnetic field sensors and an arrangement of compensation coils surrounding said operating region.

Many technical applications require surroundings well shielded from external magnetic fields. One example for an apparatus that requires a good compensation of magnetic fields is a particle-optical system such as electron microscopes or ion-beam exposure apparatus. In a system of this kind, a particle (electron or ion) beam is used traveling along a specific path and directed against a target to be imaged or structured, and any external magnetic field may deflect the particle beam off its path, thus deteriorating obstructing the performance of the device; this is the reason why a compensation of magnetic fields is needed. While a vacuum housing, which usually is made of aluminum or another metal of rather high conductivity, provides a sufficient shielding against high-frequency magnetic fields, typically for frequencies above 50 Hz, the compensation of low-frequency and in particular static fields requires an active shielding method, such as using a set of Helmholtz coils.

FIG. 1 shows a typical configuration to protect a region inside a field-sensitive device such as a particle-optical system PO enclosed in a cylinder-shaped housing. The device PO is situated within a so-called Helmholtz cage HC which consists of three pairs of Helmholtz coils. Each coil runs along the edges of one of the faces of the rectangular frame that represents the Helmholtz cage HC. The coils are fed electric currents chosen such that the magnetic fields induced in the coils compensate the external magnetic field. Ideally the magnetic field to be compensated is measured by a flux sensor Sn situated in the field-compensated region PO. The sensor Sn measures the three vector components of the magnetic field at its respective position. To compensate the external magnetic field with the field generated by the Helmholtz coils, a feed back loop shown in FIG. 2 is realized to minimize the effective magnetic field within the Helmholtz cage HC. The signal sn produced by the sensor Sn is used to generate a feedback signal fs0 which (amplified in an appropriate manner) drives the respective Helmholtz coils.

U.S. Pat. No. 5,073,744 discloses a method and apparatus for controlling the magnetic field value within a specified volume, using four magnetic sensors with four control loops, respectively. The control loops are mutually coupled by the magnetic field. Decoupling is achieved by resistors provided between the loops. Also in the GB 1285 694 use of more than one magnetic sensor is disclosed, namely, to generate a compensation current by means of a closed-loop control for controlling the flux in the gap between two pole pieces, and in order to account for the different flux densities in the gap, different sensors are used and their sensor signals superimposed.

A self-degaussing control loop is disclosed in GB 2154 031 A for compensating stray-fields produced by a magnetic object. In order to account for the magnetization of the magnetic object, which cannot be measured directly, a derived quantity is used, namely the current needed for the compensation. The current signal is combined with the difference field information measured by the magnetic sensors. It should be noted that from the teaching of this document, the inclusion of the current signal only serves for compensation of a magnetization present in the operating region; when the operating region is empty, the use of the current signal would become superfluous.

All the mentioned methods and apparatuses perform the compensation of magnetic fields by using magnetic sensors positioned at the operating region where the magnetic field shall be compensated. Like for other applications, a particle optical system PO (FIG. 1) has various components, such as magnetic shields and high-voltage electrodes, which actually do not allow putting a flux sensor at the operating region, even though that position would be the best for measuring the actual magnetic field for active field compensation with feedback control. What is more, the particle beam is reserved for the beam and does not allow the presence of a flux or magnetic field sensor. In particular it is the area of the particle beam where the magnetic field should be compensated, and where it is impossible to measure the magnetic field since the presence of sensors would obstruct the passage of the beam needed for operation of the device. Of course, the sensor is moved to a position outside the device to be compensated, e.g. to the sensor position S1 in FIG. 1. Then, however, the magnetic field measured by the sensor will, in general, be deviating from the magnetic field in the device, in particular the field where the particle beam propagates. The deviation is a consequence of the fact that the magnetic field will not be uniform, but spatially changing.

SUMMARY OF THE INVENTION

The present invention sets out to overcome the above-mentioned shortcomings of the state of the art. While it is in general not too difficult to rule out interfering fields from the vicinity of the apparatus, it is often impossible for the operator of the apparatus to avoid intrusion from far-away sources, such as electric supply lines, electric traffic engines and the like, which can cause distinct magnetic fields over distances of several 100 m or even more.

This task is solved according to the invention by a magnetic field compensation method of the kind as mentioned in the beginning with the following steps:

- the magnetic field is measured by at least two sensors located at different positions outside the operating region, generating respective sensor signals,
- the sensor signals of the sensors are superposed to a feedback signal,
- the feedback signal is converted by a controlling means to a driving signal, and
- the driving signal is used to steer at least one compensation coil, wherein furthermore, the driving signal is used to derive an additional input signal for the superposing step to generate the feedback signal.

The task is likewise solved by a system with a number of magnetic field sensors and an arrangement of compensation coils surrounding said operating region, comprising

- at least two sensors located at different positions outside the operating region, measuring the local magnetic field and generating respective sensor signals,
- a superposing means adapted to superpose the sensor signals of said sensors to a feedback signal, a controlling means adapted to convert the feedback signal to a driving signal, a compensation coil steered by the driving signal, wherein the driving signal is connected to an additional feedback branch of the superposing means.

This solution allows an enhanced compensation of static and low-frequency fields of slow spatial variation (wave length well above the overall dimension of the shielding cage) by means of a surprisingly simple addition to the feedback loop despite the fact that the magnetic sensors are not located in the operating region. The signals of the sensors and signals that are proportional to the current in the Helmholtz coils are scaled and added in a mixer unit (viz., the superposing means) in order to obtain signals which directly correspond to the signals that would be produced by a sensor positioned right within the device to be compensated (e.g. in the path of the particle beam). Thus the systematic difference between the mean value of the sensors and the field in the device can be corrected in a simple and reliable manner. It is worthwhile to note that the current signal is used to account for the distance between the sensor position form the (center of) the operating region, not for the stray field of some magnetized object as in GB 2154 031 A.

Preferably the driving signal may be converted by an amplifier to a secondary driving signal from which the additional input signal is derived by means of a calibrating means. The secondary driving signal is then fed to the additional feedback branch via a calibrating means.

In order to allow for compensation of static field gradients or zero point offsets, an external signal may be used as an additional setpoint signal for superposition with the feedback signal.

While the sensors have to be positioned outside the operating region, it will be suitable to position them at the fringe of or close to the operating region. It is advantageous if the sensors are positioned in the vicinity of the operating region at positions symmetric to each other with respect to a symmetry axis of the operating region. In this case the sensor signals of said symmetrically positioned sensors may be superposed by averaging said signals to a mean signal which is then processed as feedback signal.

It should be appreciated that the magnetic field is a vector component, and generally the shielding is to be done for all three vector components. Therefore, the compensation may be implemented as three sub-systems for three magnetic field components, respectively, corresponding to different spatial directions independently of each other, with the sensor positioned in positions adapted to derive feedback signals, each corresponding to a field component and being undisturbed by the other field components. In certain cases, where the field may be treated as two-dimensional, only two components are compensated.

The situation may arise where the compensation of one field component is not possible by adjusting only one compensation field component, due to a coupling between the field components. Possible reasons are the presence of ferromagnetic material or other materials with high magnetic anisotropy, or a choice of sensor positions which does not align with the main axes of the system to be compensated. Then, cross-coupling means which provide a mixing of the compensation signals associated with the three (or two) axes according to the associated coupling matrix will be necessary to account for the coupling between the components. The cross-coupling is parametrized in terms of configuration parameters which describe the coupling between the different components and which are adjustable so as to achieve an effective de-coupling of the compensation loops.

BRIEF DESCRIPTION OF THE DRAWINGS

In the following, the present invention is described in more detail with reference to a preferred embodiment illustrated in the drawings, which schematically show.

DETAILED DESCRIPTION OF THE INVENTION

The preferred embodiment of the invention discussed in the following refers to a field compensation for a particle-optical system. It should be noted, however, that the invention is not restricted to this specific application.

Figure 1:
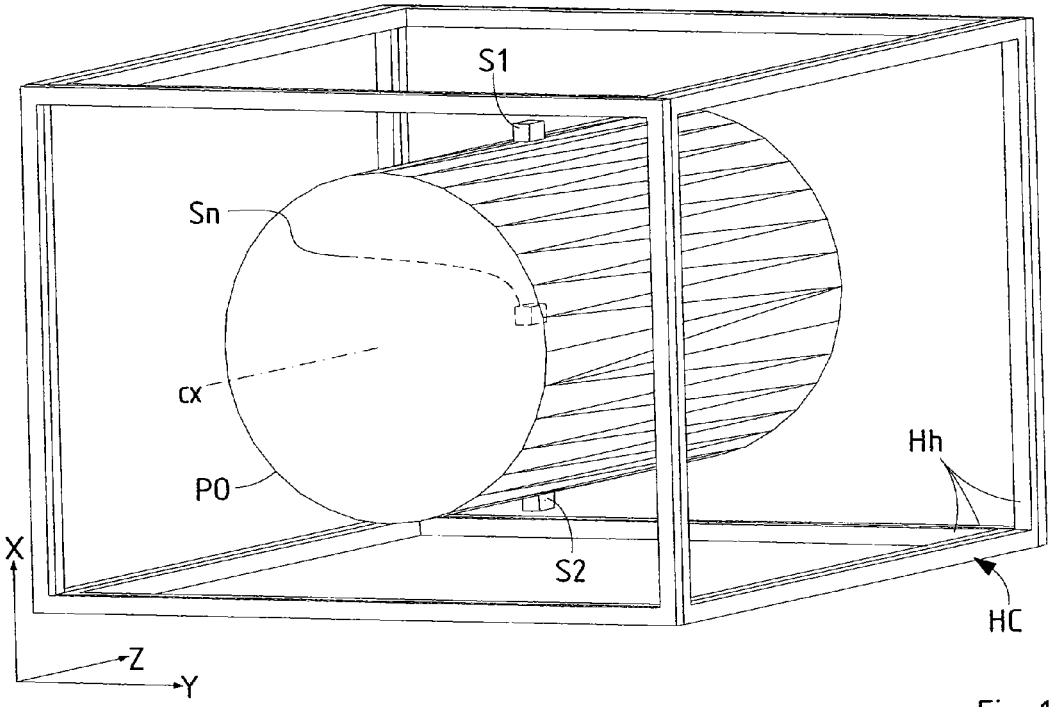
Fig. 1 PRIOR ART
FIG. 1 a particle-optical device to be magnet-shielded in a Helmholtz cage.
Figure 2:
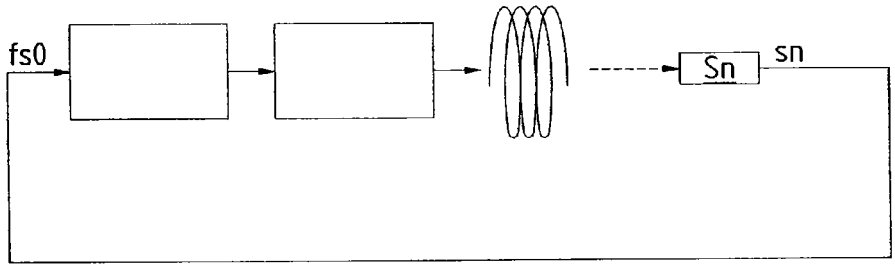
Fig. 2 PRIOR ART
FIG. 2 a state-of-the-art compensation loop.

The magnetic field compensation system according to the invention has two flux sensors S1, S2. They are mounted symmetrically to the optical axis cx of the particle optical system PO and symmetrically to the Helmholtz coils of the cage HC (FIG. 1). Each flux sensor measures the flux in three components (Bx,By,Bz) of a Cartesian coordinate system whose axes coincide with the main axes of the Helmholtz cage HC. It is also possible, in a variant, to use two times three sensors for the field components Bx, By and Bz.

Figure 3:
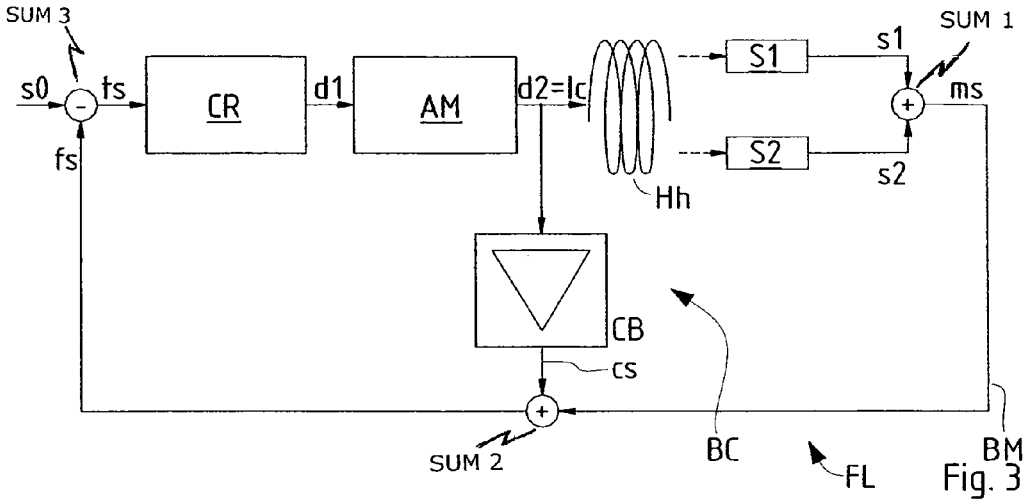
FIG. 3 a compensation loop according to the invention.
Figure 4:
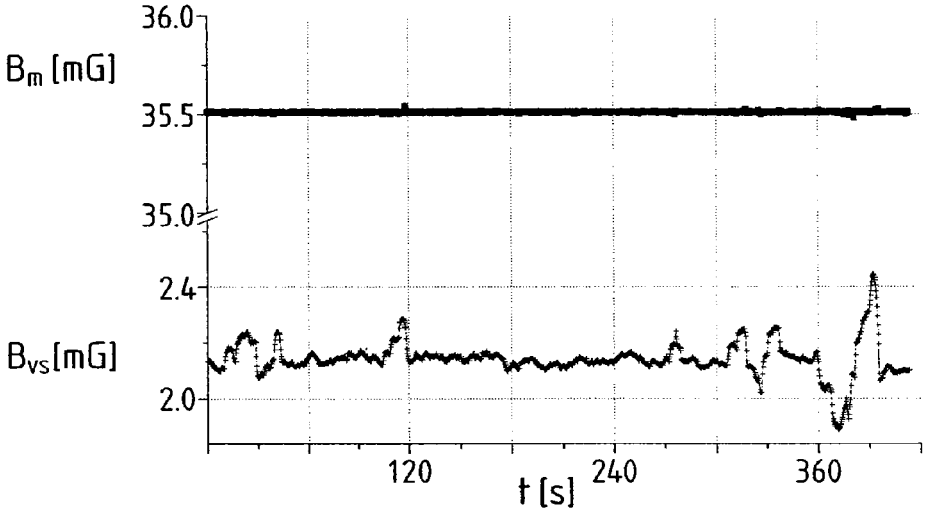
FIG. 4 the magnetic fields in a system with a simple compensation loop without a feedback according to the invention.

FIG. 3 shows the feedback loop FL according to the invention used for one of the field components, for instance the vertical component Bx; the total compensation system uses three loops as the one shown in FIG. 4. Each sensor S1, S2 for each axis of the system produces a signal s1, s2 which measures:

1. the disturbing field from the outside, for example the earth field but also any artificial field within the frequency range of the sensors,
2. the magnetic field generated by that Helmholtz coil Hh which is intended to compensate the field in the direction of its respective axis and
3. the magnetic field of the Helmholtz coils that should compensate the field in the direction of the other axes. This part is unwanted, because it leads to a coupling between the control loops for Bx, By and Bz.

To avoid this coupling, the sensors Si, S2 are mounted in such a way that the part of the signal s1, s2 which comes from a coil for a different component has the same size and the opposite sign in the two sensors that are used for each field component. By building the mean value ms of the two sensors, the signals for the three components are separated and do not influence each other. The averaging is done by a summation device SUM1 symbolized by a circle with a plus sign. The summation generates a signal corresponding to the average of the input signals; in other variants, which are equally functional, it may realize an addition of the two signals or any other kind of linear superposition of the input signals.

The sensors S1, S2 are mounted as close to the beam as possible, in order to get field values corresponding to the field in the region PO of the beam as closely as possible. However, if the magnetic field in the region of the beam is not completely homogenous, the sensors will measure field values different from the field at the location of the beam. Therefore, two sensors S1, S2 are used placed symmetric to the beam, and from the sensor signals s1, s2 a mean value ms is generated and used as a primary feedback signal for the control system. In particular if the disturbing field has a gradient which is nearly constant, the mean value of the two sensors is a good approximation for the field at the middle position between the sensors.

However, while the method of forming the mean value ms usually serves well for compensation of magnetic field gradients, it cannot compensate for all deviations between the place of the sensors and the place of desired field compensation in all configurations. In the above described system, the part of the flux which comes from the coils is not the same in the particle optical axis cx and at the flux sensors S1, S2. Because of the symmetry of the arrangement, the difference is the same in both sensors belonging to the same field component (Bx, By or Bz); this error cannot be compensated by computing the mean value.

To correct this effect, a further branch BC ('coil feedback branch') is introduced into the feedback of the control loop. This branch produces a signal cs which is proportional to the current Ic with which the coil is operated. The signal claims and the signal ms from the flux sensor branch BM are added by summation device SUM2 to obtain an enhanced feedback signal fs.

In another way of speaking, the two sensors S1, S2 and the device which generates the signal proportional to the current in the Helmholtz coil claims, together with the summation device(s), represent a 'virtual flux sensor' which generates an enhanced feedback signal. The enhanced feedback signal is very similar to the signal of a real sensor that would be mounted at a position inside the region PO of the particle beam (but would impede operation of the device as it obstructs the propagation of the particle beam).

The feedback signal may, furthermore, be combined with a setpoint signal s0 representing other static field contributions to be compensated. Preferably, this is done by a summation device SUM 3 with a negative weight for the feedback signal fs (subtractor), in order to obtain the negative feedback needed for an overall suppressive action of the feedback loop FL.

The resulting total signal ts is fed as input signal to a controller CR, for instance a PI or PID controller, whose parameters are adapted to the specific configuration and time constants of the Helmholtz coil Hh and the loop FL. The controller CR generates a primary driving signal d1 which defines the strength of the current Ic of the Helmholtz coil Hh. An amplifier AM amplifies the signal d1 output by the controller CR into a secondary driving signal d2 which is used as driving current for the coil Hh.

In the embodiment shown in FIG. 4, the secondary signal d2 is used in the coil feedback branch BC, for instance by branching off a small but proportional fraction of the current Ic of the coil Hh. Alternatively, if the amplifier AM is fast enough, the input signal d1 of the amplifier can be used as feedback component in the branch BC to be added into the feedback signal fs.

A magnetic field compensation system of the type shown in FIG. 3 was used in an ion-optical projection system to reduce the influence of the earth field and of magnetic field contributions generated by artificial sources such as the tram, the underground and others. FIG. 1 shows the cylindrical vacuum housing of the machine. Because of the fact that it was not possible to place the sensors inside the vacuum housing, they were far away from the ion optical axis. The first sensor S1 was placed at the top side of the housing, and the second sensor S2 at its bottom position.

For calibration of the magnetic field compensation, a third sensor (verification sensor) was placed on the ion optical axis; this was, of course, only possible while the housing is vented.

FIG. 4 shows the result of the magnetic field compensation working without the invented additional feedback branch BC. The flux at the sensors S1, S2 that were used for the control of the flux was constant within about 10 μG. At the same time, the verification sensor in the optical axes measured variations of the magnetic field up to 0.7 mG amplitude.

Figure 5:
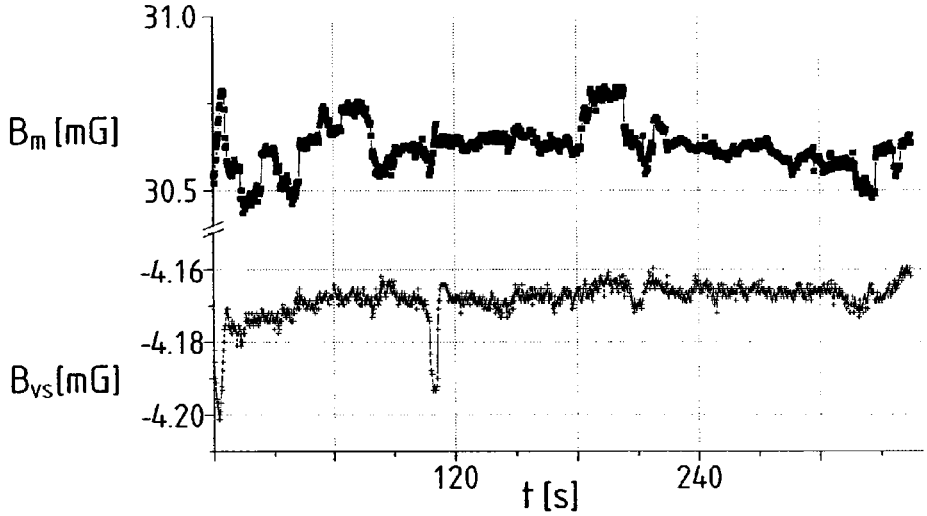
FIG. 5 the magnetic fields in a system according to the invention.

The result after implementation and calibration of the additional feedback branch BC is shown in FIG. 5. Of course, the sensors S1, S2 gave no constant signal anymore, but the verification sensor (which is not a part of the control loop) gave a signal changing only about 40 μG amplitude throughout the measurement; note that the vertical scale of the signals is different in FIGS. 4 and 5, respectively. Thus, the feedback loop according to the invention gave an improvement of a factor 17 in the stability of the flux in the optical axis cx of this ion projection system PO.

Figure 6:
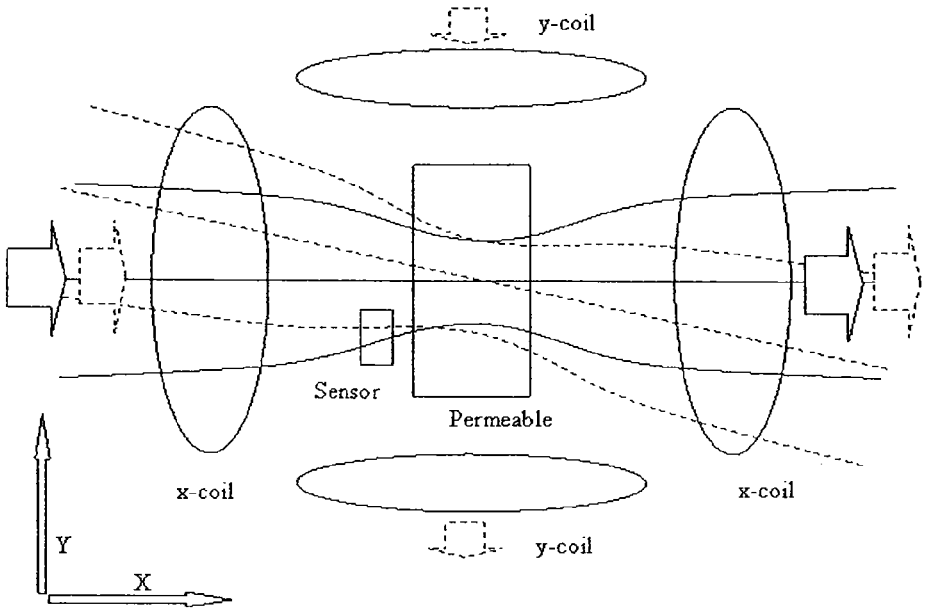
FIG. 6 a magnetic coupling of the compensation between main axes.

In some cases, e.g. in case of the presence of ferromagnetic material, the measured field components and those generated by the X, Y and Z coils are not rectangular to each other. The reason for this is that the magnetic field produced by, say, the X coil may be distorted and/or rotated due some permeable material which will also be picked up in the magnetic sensor, as illustrated in FIG. 6. Due to the effect of the permeable material, the field produced by the X Helmholtz coil and originally oriented along the X axis may be modified by some perpendicular field component; this may also be seen as if the field is rotated to some extent. As a consequence, not only the compensation of the disturbance in the X axis field is affected, but the "rotation" of the generated field causes additional field components in the other axes; in FIG. 6, a coupling of the X axis to the Y axis is illustrated. Thus, a coupling between the three axes is the result. One possible solution to decouple the axes is the rotational alignment of the X, Y, Z axes of the magnetic sensors such that one sensor axis only responds to one of the coils. This is possible in principle, but since it depends on the configuration of the magnetic materials present in a delicate way, in many cases will be much too tedious to be practical.

Therefore, another solution to decouple the axes may be used. In contrast to the above example with electronically independent X Y Z feedback loops from the basic configuration, the three loops are combined together in the following manner.

Figure 7:
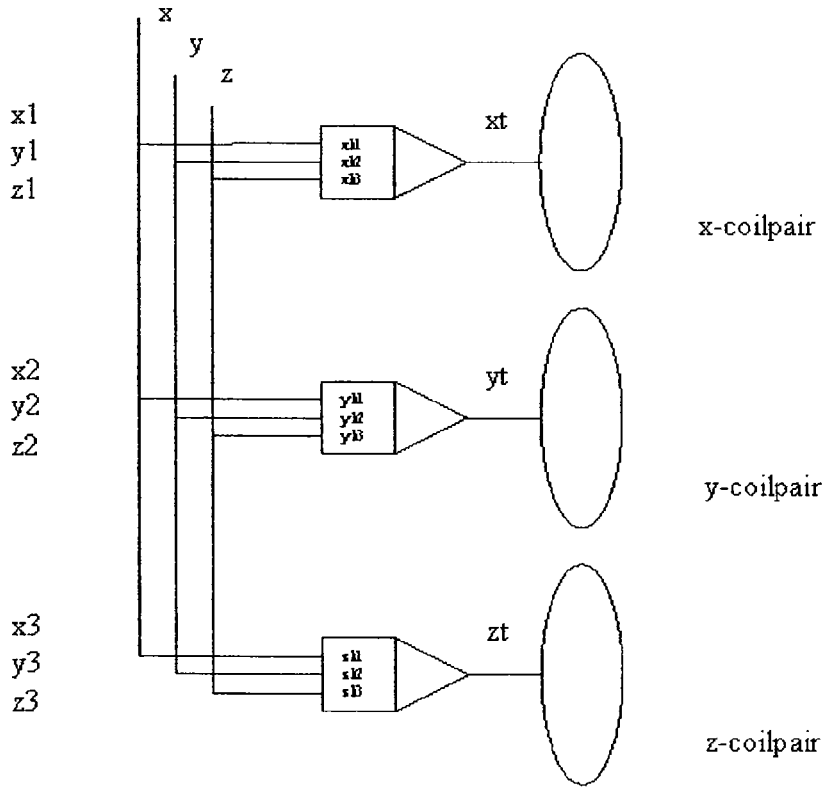
FIG. 7 a circuit for decoupling cross-influences (FIG. 6) between the three main axes.

As illustrated in FIG. 7 the e.g. X sensor signal to the X coil the X sensor signal is split into three parallel signals x1 x2 x3, each equal to the original signal x scaled individually by means of some adjustable coefficients kx1, kx2, kx3 thus giving the signals x1=kx1·x, x2=kx2·x, x3=kx3·x. For the Y and Z signals, likewise signals y1, y2, y3 and z1, z2, z3 are obtained. On the coil side an adding circuit just in front of the coil input is inserted. This circuit has 3 inputs in order to sum up the signals x1, y1, z1 giving the actual control signal xt=x1+y1+z1 for the x-coil input. In analogy at the Y coil a circuit will sum up yt=x2+y2+z2, and at the Z coil zt=x3+y3+z3.

By carefully adjusting the coefficients kx1, kx2, . . . , kz3 it is now possible to generate a field with non-zero components in X, Y and Z directions for compensating a disturbance with only one component in the e.g. X axis at the magnetic sensor without introducing any false compensations in the remaining Y and Z axes.

The three adding circuits of FIG. 7 represent cross-coupling means for taking into account the coupling (or mixing) of the different directions of the magnetic field. The cross-coupling is inserted at any place in the feedback branch, preferably before or after the controller CR or before the coils Hh, with the signals ts, d1 or d2, respectively. In a variant, the cross coupling can also be performed numerically using a (digital or analog) matrix calculation in the controller CR.

We claim:

1. A method for compensation of a magnetic field in an operating region (PO), using magnetic field sensors (S1, S2) and an arrangement (HC) of compensation coils (Hh) surrounding said operating region, the method comprising the following steps:

the magnetic field is measured by at least two sensors (S1, S2) located at different positions outside the operating region, generating respective sensor signals (s1, s2), the sensor signals of said sensors are superposed to a feedback signal (ms, fs), the feedback signal is converted by a controlling means to a driving signal (d1), and the driving signal is used to steer at least one compensation coil (Hh), the improvement comprising that the driving signal is further used to derive an additional input signal (cs) for the superposing step to generate the feedback signal (fs).

2. The method of claim 1, wherein the driving signal is converted by an amplifier (AM) to a secondary driving signal from which the additional input signal is derived by means of a calibrating means (CB).

3. The method of claim 1, wherein an external signal (sO) is used as an additional setpoint signal for superposition with the feedback signal (ms, fs).

4. The method of claim 1, wherein the sensors are positioned in the vicinity of the operating region at positions symmetric to each other with respect to a symmetry axis (cx) of the operating region.

5. The method of claim 4, wherein the sensor signals of said symmetrically positioned sensors are superposed by averaging said signals to a mean signal.

6. The method of claim 1, wherein the compensation is done for two magnetic field components corresponding to different spatial directions independently of each other, with the sensors positioned in the positions configured to derive the feedback signal, each corresponding to a field component and being undisturbed by the other field components.

7. The method of claim 6, wherein a cross-coupling between compensation loops for the magnetic field components is calculated and added to the feedback signals.

8. The method of claim 1, wherein the compensation is done for three magnetic field components corresponding to different spatial directions independently of each other, with the sensors positioned in the positions configured to derive the feedback signal, each corresponding to a field component and being undisturbed by the other field components.

9. The method of claim 8, wherein a cross-coupling between compensation loops for the magnetic field components is calculated and added to the feedback signal.

10. The method of claim 1, wherein the sensors (S1, S2) are positioned laterally to the operating region (PO) with regard to a main axis (cx) of the operating region.

11. The method of claim 1, wherein the sensors (S1, S2) are magnetic flux sensors and the additional input signal (cs) is proportional to the current with which the compensation coil is driven.

12. A system for compensation of a magnetic field in an operating region (PO), with magnetic field sensors (S1, S2) and an arrangement (HC) of compensation coils (Hh) surrounding said operating region, the system comprising:

at least two sensors (S1, S2) located at different positions outside the operating region, measuring a local magnetic field and generating respective sensor signals (s1, s2), a superposing means (BM) configured to superpose the sensor signals of said sensors to a feedback signal (ms, fs), a controlling means (CR) configured to convert the feedback signal to a driving signal (d1), and a compensation coil (Hh) steered by the driving signal, the improvement comprising that the driving signal is connected to an additional feedback branch (BC) feeding the superposing means.

13. The system of claim 12, further comprising an amplifier (AM) for conversion of the driving signal to a secondary driving signal which is fed to the additional feedback branch (BC) via a calibrating means (CB).

14. The system of claim 12, wherein an external signal (s0) is also fed to the controlling means (CR) as an additional setpoint signal for superposition with the feedback signal (ms, fs).

15. The system of claim 12, wherein the sensors are positioned in the vicinity of the operating region at positions symmetric to each other with respect to a symmetry axis (cx) of the operating region.

16. The system of claim 15, wherein the superposing means is configured to superpose the sensor signals of said symmetrically positioned sensors by averaging said signals to a mean signal.

17. The system of claim 12, comprising three sub-systems for compensation of three magnetic field components corresponding to different spatial directions independent of each other, with the sensors positioned in the positions configured to derive the feedback signal, each corresponding to a field component and being undisturbed by the other field components.

18. The system of claim 12, further comprising two sub-systems for compensation of two magnetic field components corresponding to different spatial directions independent of each other, with the sensors positioned in the positions configured to derive the feedback signal, each corresponding to a field component and being undisturbed by the other field components.

19. The system of claim 17, with cross-coupling means between compensation loops for the magnetic field components.

20. The system of claim 18, with cross-coupling means between compensation loops for the magnetic field components.

21. The system of claim 12, wherein the sensors (S1, S2) are located laterally to the operating region (PO) with regard to a main axis (cx) of the operating region.

22. The system of claim 12, wherein the sensors (S1, S2) are magnetic flux sensors and the additional input signal (cs) is proportional to the current with which the compensation coil is driven.

* * * * *